US007384593B2

(12) United States Patent
Kuhlmann et al.

(10) Patent No.: US 7,384,593 B2
(45) Date of Patent: Jun. 10, 2008

(54) CYCLONE PLUG

(75) Inventors: Jurgen Kuhlmann, Bad Salzuflen (DE); Werner Ritter, Mendig (DE); Klaus Guido Ruwier, Bad Honningen (DE); Werner Schonwelski, Neuwied (DE)

(73) Assignee: LWB Refractories GmbH, Hilden (DE)

( * ) Notice: Subject to any disclaimer, the term of this patent is extended or adjusted under 35 U.S.C. 154(b) by 0 days.

(21) Appl. No.: 11/454,709

(22) Filed: Jun. 16, 2006

(65) Prior Publication Data

US 2006/0220282 A1 Oct. 5, 2006

Related U.S. Application Data

(63) Continuation of application No. 10/626,297, filed on Jul. 24, 2003, now abandoned.

(30) Foreign Application Priority Data

Jun. 6, 2003 (DE) ..... 103 26 113

(51) Int. Cl.
*C21C 5/48* (2006.01)

(52) U.S. Cl. ..... 266/220; 266/217

(58) Field of Classification Search ..... 266/220, 266/217

See application file for complete search history.

(56) References Cited

U.S. PATENT DOCUMENTS

| | | | | |
|---|---|---|---|---|
| 4,938,461 A | | 7/1990 | Bertollo | 266/266 |
| 4,944,496 A | * | 7/1990 | Thrower et al. | 266/220 |
| 5,037,072 A | * | 8/1991 | King et al. | 266/268 |
| 5,050,847 A | | 9/1991 | King | 266/220 |
| 5,104,097 A | | 4/1992 | Naujokat | 266/217 |
| 5,286,004 A | * | 2/1994 | Rothrock, Jr. | 266/217 |
| 6,551,550 B1 | | 4/2003 | Aramaki | 266/220 |

FOREIGN PATENT DOCUMENTS

| | | |
|---|---|---|
| DE | 36 25 117 C1 | 11/1987 |
| DE | 39 04 543 C2 | 11/1989 |
| GB | 2 276 437 | 9/1994 |
| JP | 11-269532 | 10/1999 |

OTHER PUBLICATIONS

Hammerer, W. et al., "Gas Purging for Steel Ladles", *Radex Rundschau, Grafelfing, De.*, 1992, 217-226, XP 000770551, Dec. 1992.

* cited by examiner

*Primary Examiner*—Scott Kastler
(74) *Attorney, Agent, or Firm*—Woodcock Washburn LLP

(57) ABSTRACT

A gas lance made of a fireproof material, having an entry surface and an exit surface, having channels having slit-shaped cross-section, which comprise an entry slit and an exit slit. In order to provide a gas lance in which the gas exits in such a manner that a good thorough mixing of the melt is achieved and a simple penetration of the melt by the gas is avoided, the projection of the exit slit of a channel onto the entry surface may be offset in relation to the entry slit of the channel.

8 Claims, 5 Drawing Sheets

CYCLONE PLUG

CROSS REFERENCE APPLICATIONS

Figure 1:
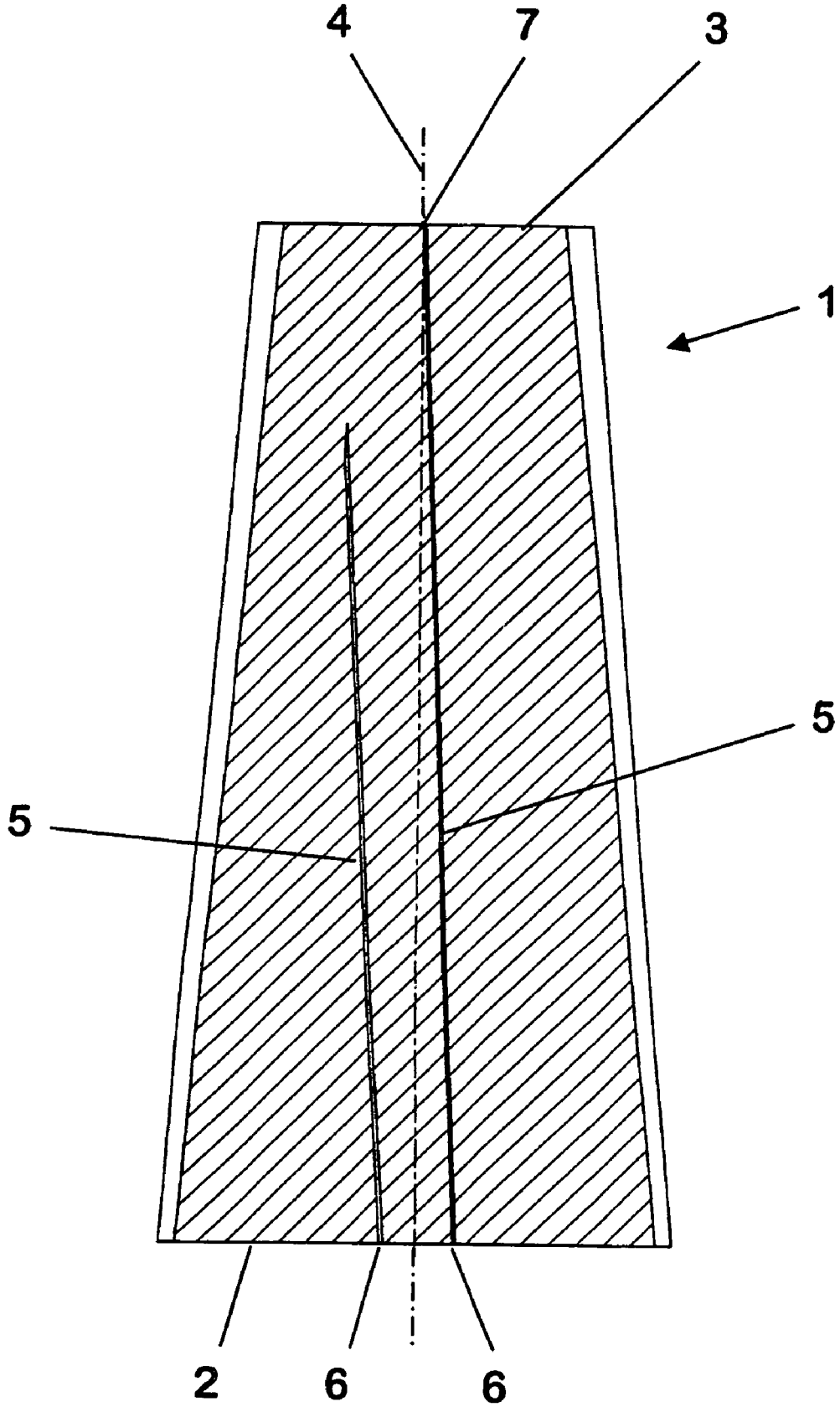

This is a continuation of application number 10/626,297 filed Jul. 24, 2003 now abandoned, which claims priority to German application number 103 26 113.3-24 filed Jun. 6, 2003, the contents of which is incorporated by reference herein in its entirety.

The present invention relates to products for high temperature applications, and more particularly to a gas lance made of a fireproof material.

BACKGROUND

Gas lances are used in metallurgical melt vessels, such as converters or ladles, in order to treat the melt contained therein by blowing in gases, e.g. $CO_2$. The streaming gas is supposed in particular to cause turbulence, thus causing a thorough mixing of the melt. The gases flow past the entry surface, which preferably faces the floor of the metallurgical vessel, into the gas lance, and exit at the exit surface. The gas lance is integrated into the fireproof lining of the melt vessel.

The gas lance can on the one hand be made of a porous fireproof material, so that the gas flows through the lance as a whole, thus resulting in a finely distributed flow of gas inside the melt. On the other hand, channels can also be situated in the gas lance via which the gas is distributed in the melt.

From DE 36 25 117 C1, on which the present invention is based, a gas lance is known that is fashioned as a truncated cone and has slit-shaped channels running parallel to the axis of the truncated cone whose cross-sections point radially outward in a star-shaped pattern. In addition, the channels taper towards the exit surface in such a way that the length of the slit-shaped cross-section of the channels decreases.

A disadvantage of a gas lance of this type is that there is the risk there will take place merely a penetration of the gas through the melt column situated over the exit opening. In such a case, there will not be a turbulence of the melt; rather, the melt will remain essentially at rest. The desired mixing effect is then not achieved.

SUMMARY

On the basis of this prior art, the underlying object of the present invention is to provide a gas lance in which the gas exits in such a manner that a good mixing of the melt is achieved, and a simple penetration of the melt by the gas is avoided.

This object is achieved in that the projection of the exit slit of a channel onto the entry surface is offset or staggered in relation to the entry slit of the channel. The gas lance made of a fireproof material has an entry surface and an exit surface, and channels having a slit-shaped cross-section that have an entry slit and an exit slit. The gas lance is fashioned as a truncated cone at whose ends the entry surface and exit surface are situated. The entry slits are situated in the entry surface and the exit slits are situated in the exit surface. The channels run between the entry surface and the exit surface and the slit-shaped cross-sections of the channels point essentially radially outward from the axis of the truncated cone.

Due to the fact that the projection of the exit slit is offset in relation to the entry slit, the channels are inclined in relation to the axis of the truncated cone. This has the result that the direction of flow of the exiting gas is not perpendicular to the exit surface, but rather is inclined to this surface. The ferrostatic pressure therefore does not stand perpendicular to the channels. On the one hand, this has the advantage that the risk of a mere penetration of the melt column situated above the exit surface is reduced. On the other hand, the oblique exit of the gas causes a turbulence in the melt, so that especially good mixing rates are achieved. The degree of turbulence is moreover further increased in that the gases exit the slits with a "twist."

If the projections of the exit slits onto the entry surface are offset relative to the truncated cone axis in a uniform direction of rotation to the entry slits, there results a rotationally symmetrical flow field of the exiting gases, which in turn results in an effective turbulence of the melt in the area of the gas lance. In particular, the rotationally symmetrical flow field results in a rotational movement of the melt, producing a good thorough mixing.

If the exit slits are offset parallel to the entry slits, a simple manufacture of the channels inclined to the truncated cone axis is enabled.

An especially good turbulence can be achieved in the area of the gas lance if the exit slits extend radially outward from the truncated cone axis in a star-shaped pattern.

In order to achieve an overall exit surface that is as large as possible while maintaining the rotational symmetry, it can be advantageous if the exit slits have different lengths.

If a volume of gas flow that is as large as possible is required, it is advantageous if the slit-shaped cross-section of the channels has a constant length along its run. In contrast, if a higher gas pressure is to be achieved in the area of the exit slits it is preferable if the length of the slit-shaped cross-section of the channels decreases from the entry slit to the exit slit. This can in particular be required if a penetration of the melt into the channels is to be prevented.

In addition, it has proven advantageous if the width of the slit-shaped cross-section of the channels, as well as of the entry and exit slits, is between 0.125 and 0.5 mm. On the one hand, this prevents the melt from penetrating into the channels, and on the other hand a sufficiently large volume of gas flow is ensured.

BREIF DESCRIPTION OF THE FIGURES

The present invention is explained in more detail in the following, on the basis of a drawing representing exemplary embodiments that are merely preferred.

Figure 2:
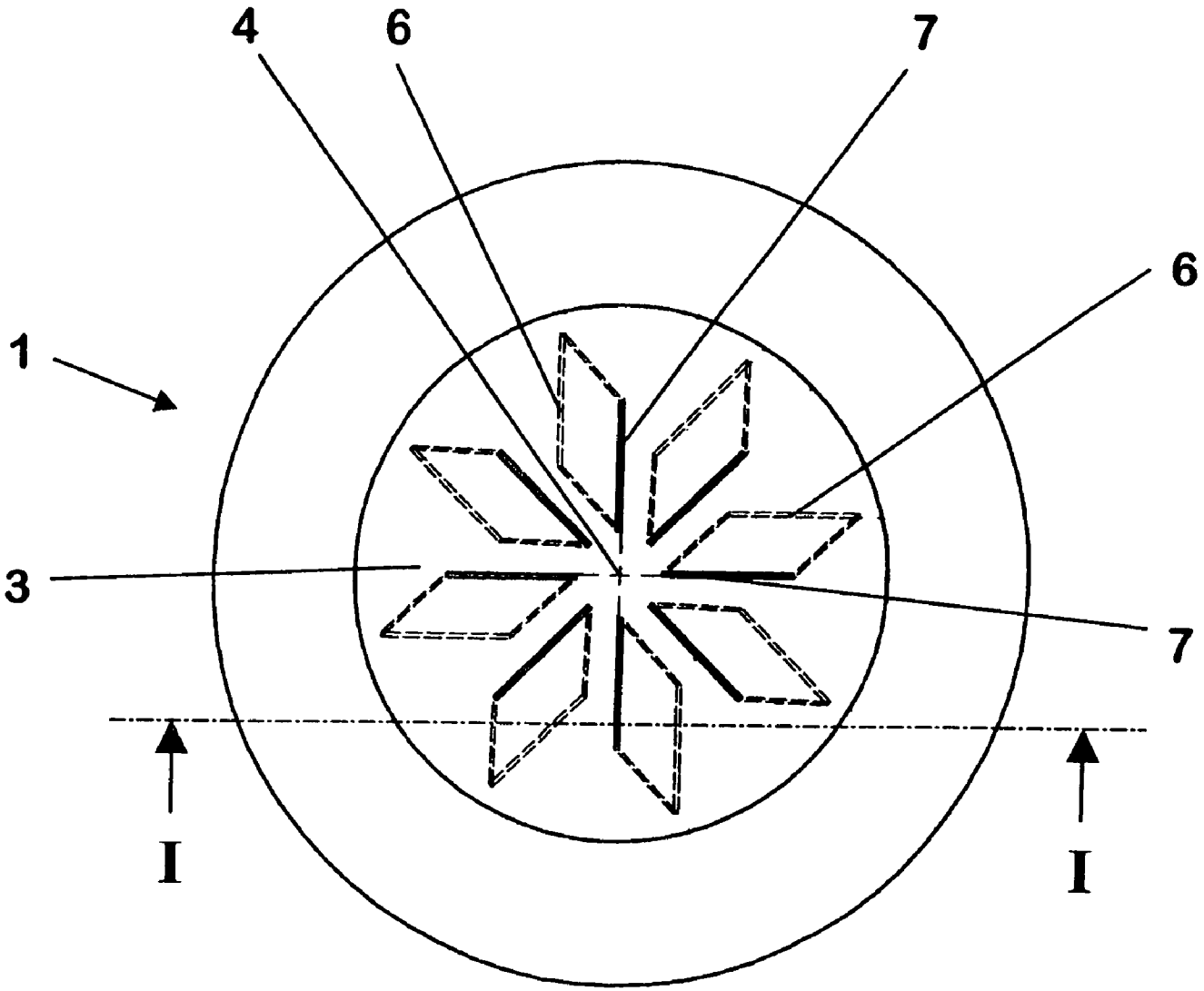
Figure 3:
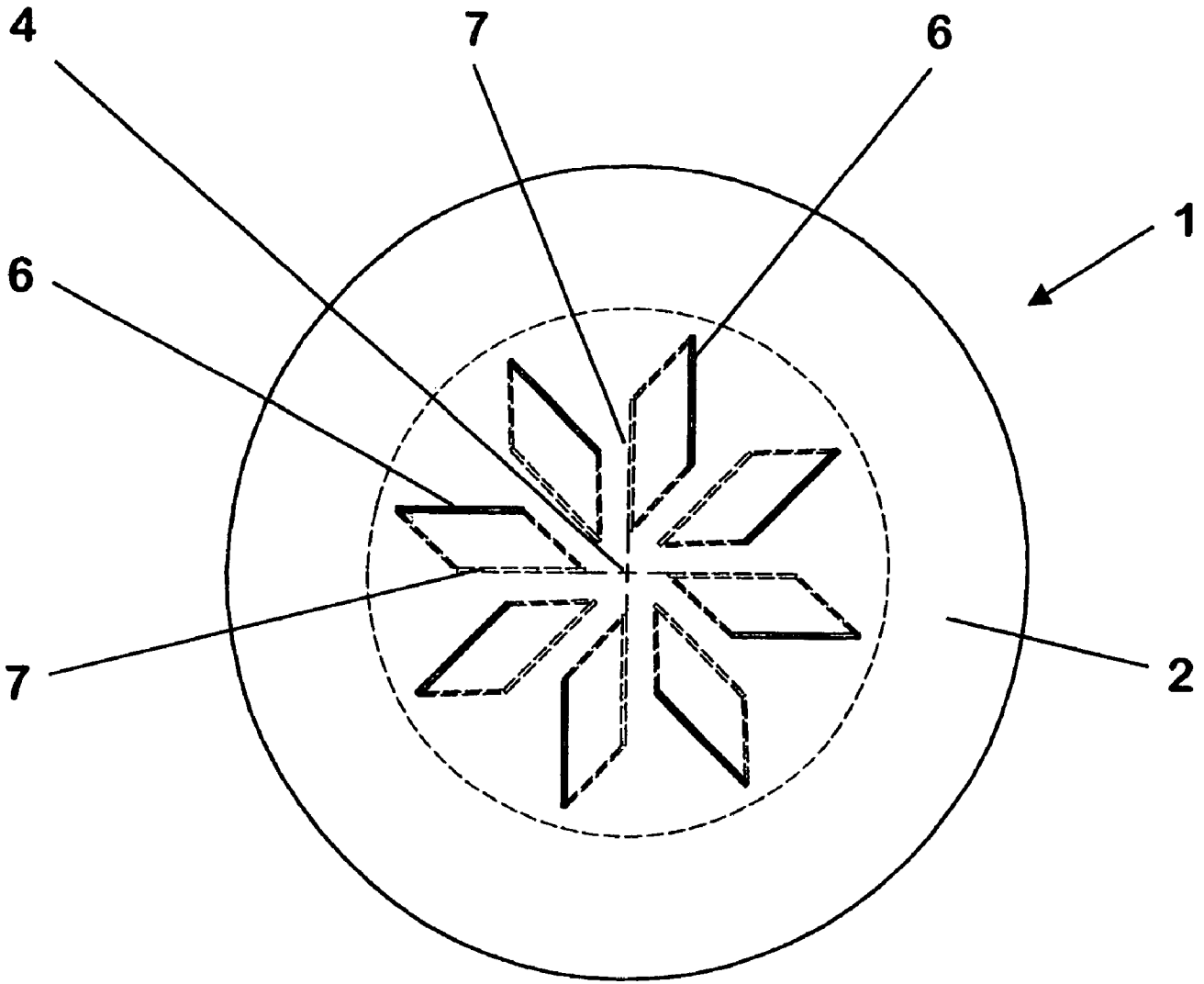
Figure 4:
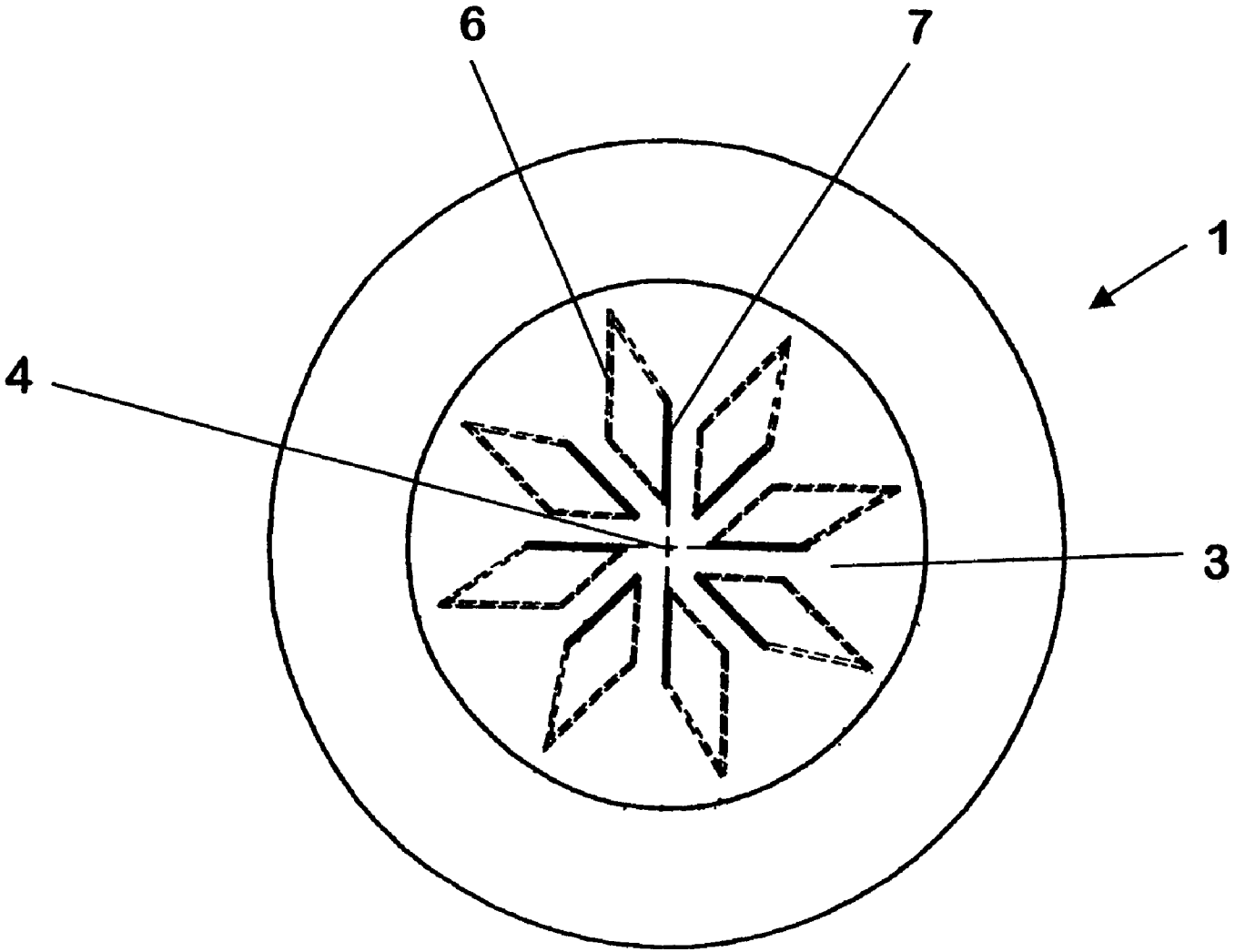
Figure 5:
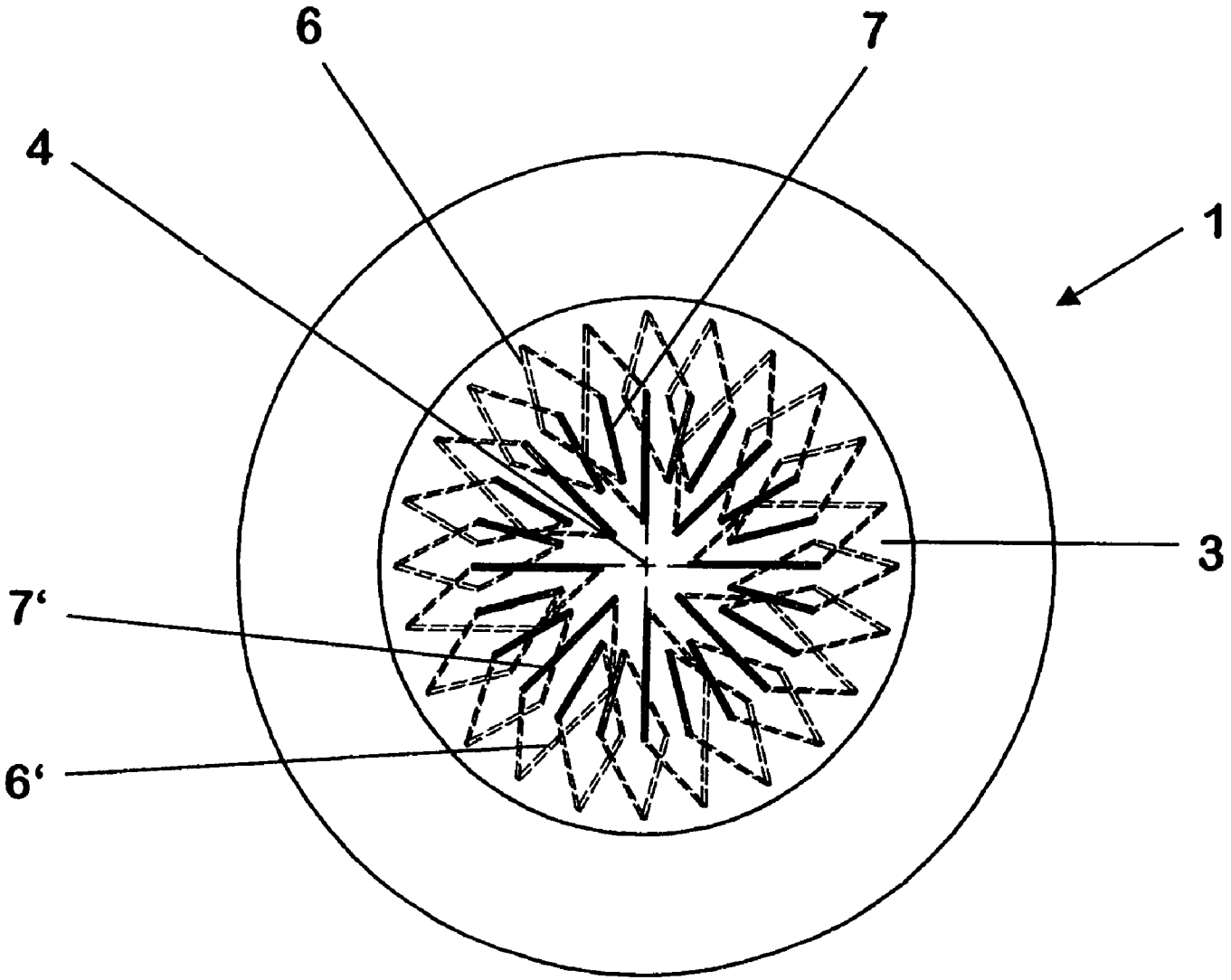

FIG. 1 shows a first exemplary embodiment of a gas lance according to the present invention, in longitudinal section, FIG. 2 shows the exit surface of a first exemplary embodiment of a gas lance according to the present invention, in a top view, FIG. 3 shows the entry surface of a first exemplary embodiment of a gas lance according to the present invention, in a top view, FIG. 4 shows the exit surface of a second exemplary embodiment of a gas lance according to the present invention, in a top view, and FIG. 5 shows the exit surface of an additional exemplary embodiment of a gas lance according to the present invention, in a top view.

DETAILED DESCRIPTION OF PREFERRED EMBODIMENTS

Gas lance 1, shown in FIG. 1 in longitudinal section along the line I-I in FIG. 2, has the shape of a truncated cone. Gas lance 1 has an entry surface 2 and an exit surface 3, and both entry surface 2 and also exit surface 3 run perpendicular to axis 4 of the truncated cone. Gas lance 1 is made of a fireproof material, in particular a fireproof ceramic.

Channels 5 having a slit-shaped cross-section run between entry surface 2 and exit surface 3. Channels 5 each run from an entry slit 6, situated in entry surface 2, up to an exit slit 7 situated in exit surface 3. The width of the cross-section of channels 5 perpendicular to its direction of extension is between 0.125 and 0.5 mm. The slit-shaped cross-sections of channels 5 point essentially radially outward from truncated cone axis 4, as can be seen in FIG. 2. In the exemplary embodiment shown in FIGS. 1 to 3, exit slits 7 additionally extend radially outward from truncated cone axis 4 in a star-shaped pattern. Moreover, the length of the slit-shaped cross-section of channels 5 is constant along its run.

As can be seen in FIG. 3, the projections of exit slits 7 onto entry surface 2 are offset in relation to entry slit 6 of each channel 5, so that the projection of exit slit 7 does not coincide with the respective entry slit 6. It results from this that channels 5 run at an incline to truncated cone axis 4, and in particular meet exit surface 3 obliquely. FIG. 3 additionally shows that in the depicted, and to this extent preferred, exemplary embodiment, all projections of exit slits 7 are respectively offset to the left relative to the corresponding entry slits 6. The projections are thus offset to entry slits 6 in a uniform direction of rotation relative to truncated cone axis 4. Moreover, the projection of each exit slit 7 runs parallel to entry slit 6.

When gas flows from entry surface 2 into gas lance 1, this gas flows from entry slits 6 through channels 5 to exit slits 7 situated in exit surface 3. Here, the direction of flow of the gas at exit slit 7 is inclined to exit surface 3. On the basis of the uniform direction of rotation with which the projections of exit slits 7 are offset in relation to entry slits 6, a rotationally symmetrical flow field results above exit surface 3, which causes a rotating motion of the melt in this area. This rotating motion leads to a good thorough mixing of the melt. Moreover, a simple penetration of the melt by the exiting gas, in which the melt would essentially remain at rest, is avoided.

The second exemplary embodiment of a gas lance 1 according to the present invention shown in FIG. 4 is distinguished from those previously described in that the extension length of exit slits 7 is reduced in relation to that of entry slits 6. The length of the slit-shaped cross-section of channels 5 thus decreases from entry slit 6 to exit slit 7. During the flowing through, this has the result that the pressure at exit slit 7 is increased in comparison to entry slit 6, and a penetration of the melt into channels 5 is made more difficult.

In the third exemplary embodiment, shown in FIG. 5, a part of channels 5 have exit slits 7' and entry slits 6', which have a greater length in comparison to the standard entry and exit slits 6, 7. As a result, a larger overall exit surface is created for the gas without thereby disturbing the rotational symmetry in the area of exit surface 3.

What is claimed is:

1. A gas lance formed of a fire proof material, said lance having a truncated cone-shape including:

an entry surface, and exit surface, and plural channels extending continuously therebetween;

the channels forming slits in transverse cross-section; the channels having an entry slit disposed in entry surface and an exit slit disposed in the exit surface; the slit-shaped channel transverse cross sections are oriented approximately radially from a central longitudinal axis of the lance, projections of the exit slits onto the entry surface are offset relative to the entry slits, and at least one of the exit slits has a different length in transverse cross section relative to the other exit slits.

2. The gas lance of claim 1, wherein the projections of the exit slits onto the entry surface are offset relative to the axis of the lance with a uniform direction of rotation to the entry slits.

3. The gas lance of claim 1, wherein the projections of the entry slits onto the entry surface are offset parallel to the entry slits.

4. The gas lance of claim 1, wherein the exit slits extend radially outwardly in a star-shaped pattern.

5. The gas lance of claim 1, wherein the lengths of the channels decrease from the entry slit to the exit slit.

6. The gas lance of claim 1, wherein each one of the exit slits have a constant length in transverse cross section from the entry slit to the exit slit.

7. The gas lance of claim 1, wherein the width of the channels is between 0.1 mm and 0.5 mm.

8. The gas lance of claim 1, wherein the channels are spaced apart from the peripheral surface of the truncated cone-shape.

* * * * *